US007856187B2

(12) United States Patent
Dan

(10) Patent No.: US 7,856,187 B2
(45) Date of Patent: Dec. 21, 2010

(54) IMAGE FORMING APPARATUS

(75) Inventor: Kenichi Dan, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 85 days.

(21) Appl. No.: 12/411,945

(22) Filed: Mar. 26, 2009

(65) Prior Publication Data

US 2009/0245826 A1 Oct. 1, 2009

(30) Foreign Application Priority Data

Mar. 31, 2008 (JP) ..... 2008-089725

(51) Int. Cl.
*G03G 15/20* (2006.01)

(52) U.S. Cl. ..... 399/33; 399/122

(58) Field of Classification Search ..... 399/33, 399/67–69, 107, 114, 122, 124
See application file for complete search history.

(56) References Cited

U.S. PATENT DOCUMENTS 6,950,619 B2 * 9/2005 Sunohara ..... 399/124
7,003,246 B2 * 2/2006 Gogate et al. ..... 399/122
7,392,004 B2 * 6/2008 Sato et al. ..... 399/328
2006/0180986 A1 8/2006 Hattori

FOREIGN PATENT DOCUMENTS

| | | |
|---|---|---|
| JP | 07-230227 | 8/1995 |
| JP | 09-216747 | 8/1997 |
| JP | 2002-014556 | 1/2002 |
| JP | 2006-176321 | 7/2006 |

* cited by examiner

*Primary Examiner*—Hoan Tran
(74) *Attorney, Agent, or Firm*—Banner & Witcoff, Ltd

(57) ABSTRACT

An image forming apparatus is provided, which includes: an image forming unit; a fixing unit having a heating part; a rotary drive unit; a driving force transmission unit including a displacement part displaceable to a transmitting position where rotation of the rotary drive unit is transmitted to the fixing unit and a non-transmitting position where the rotation of the rotary drive unit is not transmitted to the fixing unit; a cover configured to cover the heating part; a lock unit configured to selectively lock the cover; and a link unit configured to link the lock unit with the displacement part so that the lock unit locks the cover when the displacement part is displaced to the transmitting position and unlocks the cover when the displacement part is displaced to the non-transmitting position.

8 Claims, 9 Drawing Sheets

IMAGE FORMING APPARATUS

CROSS REFERENCE TO RELATED APPLICATION

The present disclosure relates to the subject matter contained in Japanese patent application No. 2008-089725 (filed on Mar. 31, 2008), which is expressly incorporated herein by reference in its entirety.

TECHNICAL FIELD

The present invention relates to an image forming apparatus for forming an image on a recording medium and more particularly to an image forming apparatus which includes a fixing unit for thermally fixing an image on a recording medium while transporting the recording medium.

BACKGROUND ART

An image forming apparatus includes an image forming unit for forming an image on a recording medium by various methods including electrophotography. The image formed by the image forming unit is thermally fixed while the recording medium is being transported by a fixing unit including a heating roller. Patent Document 1 discloses a first configuration for the image forming apparatus, in which when a jam occurs, a motor is rotated in a reverse direction to move a planetary gear so as to cut off the transmission of driving force from the motor to the heating roller for free rotation of the heating roller. This makes it possible to easily take out a jammed recording medium even when a jam occurs at the heating roller.

When the heating roller is heated to a high temperature, it is dangerous to touch the heating roller with the hand carelessly. Patent Document 2 proposes a second configuration for an image forming apparatus, in which the opening and closing of a housing cover is restricted while the interior of the image forming apparatus remains high in temperature.

Patent Document 1:JP-A-216747

Patent Document 2:JP-A-2002-14556

However, in the event that the first configuration and the second configuration are provided separately to the image forming apparatus, the image forming apparatus becomes complex, which increases the production costs thereof.

SUMMARY

The present invention was made in view of the above-noted and/or other circumstances.

As one of illustrative, non-limiting embodiment, the present invention can provide an image forming apparatus, which includes: an image forming unit; a fixing unit having a heating part; a rotary drive unit; a driving force transmission unit including a displacement part displaceable to a transmitting position where rotation of the rotary drive unit is transmitted to the fixing unit and a non-transmitting position where the rotation of the rotary drive unit is not transmitted to the fixing unit; a cover configured to cover the heating part; a lock unit configured to selectively lock the cover; and a link unit configured to link the lock unit with the displacement part so that the lock unit locks the cover when the displacement part is displaced to the transmitting position and unlocks the cover when the displacement part is displaced to the non-transmitting position.

Accordingly, as one of advantages, the present invention can provide an image forming apparatus having simplified configuration. As another one of the advantages, the present invention can provide an image forming apparatus that permits free rotation of a fixing unit. As another one of the advantages, the present invention can provide an image forming apparatus that can cancel the locking of a cover when the temperature of the fixing unit is lowered. These and other advantages of the present invention will be described in detail with reference to the accompanying drawings.

DESCRIPTION OF THE PREFERRED EMBODIMENT

Figure 1:
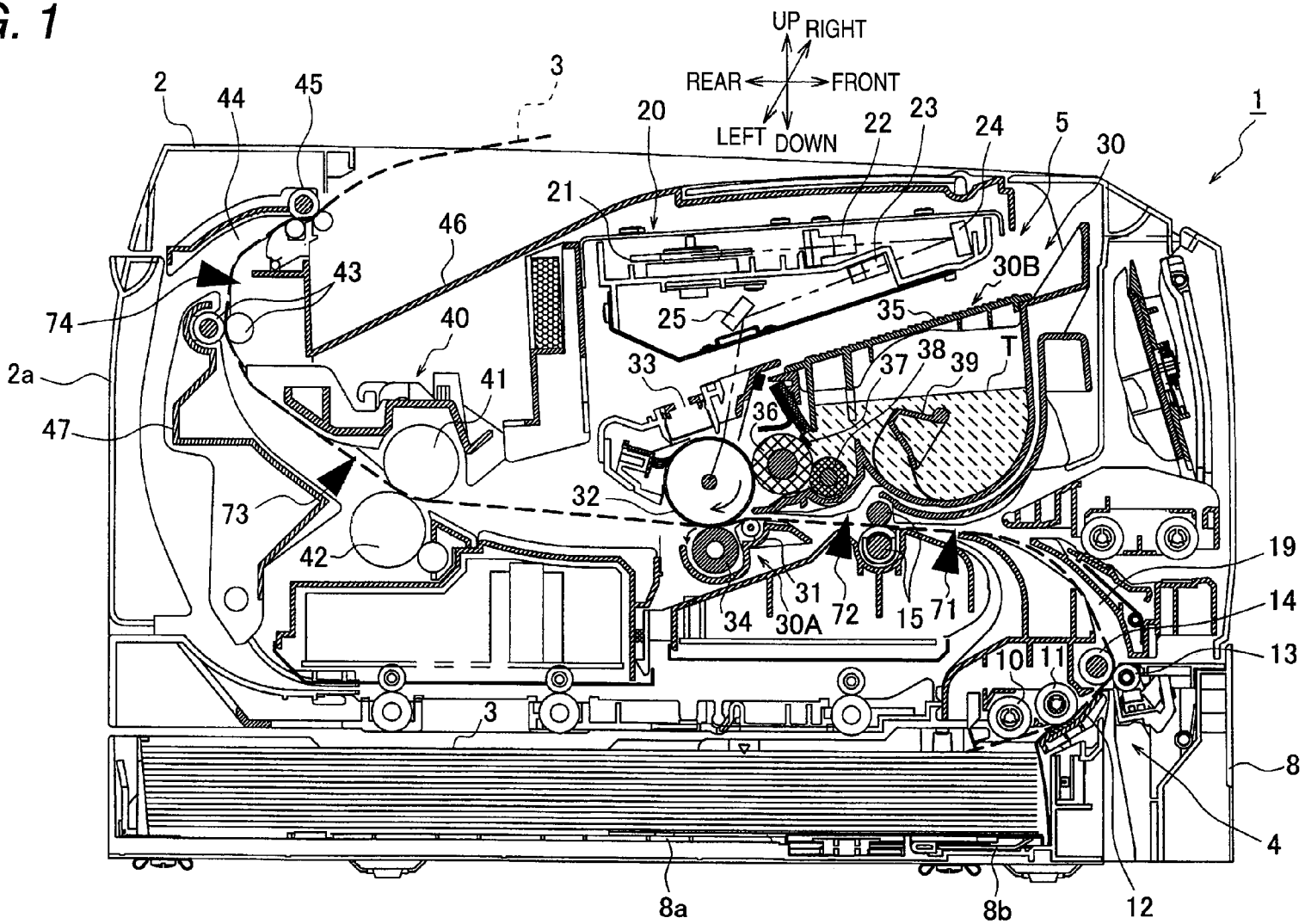
FIG. 1 is a vertical sectional view showing a schematic configuration of a laser printer.

An exemplary embodiment of the invention will be described with reference to the accompanying drawings. FIG. 1 is a vertical sectional view showing a schematic configuration of a laser printer 1 as an example of an image forming apparatus. Note that in the following description, in FIG. 1, a right-hand side is referred to as a front of the laser printer 1, and a near side (a reader side) as a left-hand side of the laser printer 1.

1. Overall Configuration of Laser Printer

As is shown in FIG. 1, a laser printer 1 includes a feeder part 4 for feeding a sheet 3 and an image forming part 5 for forming an image on a sheet 3. The feeder part 4 and the image forming part 5 are provided inside a casing 2. A rear cover 2*a* is provided at the rear of the body casing 2 to be opened and closed freely.

1.1 Configuration of Feeder Part

The feeder part 4 includes a sheet feeding tray 8, a pressing plate 8*a* and a lift plate 8*b*. The sheet feeding tray 8 is detachably attached to a bottom portion of the casing 2. The pressing plate 8*a* is disposed at a lower portion of the sheet feeding tray 8 to stack sheets 3 thereon. The pressing plate 8*a* is swingable such that a front portion of the pressing plate 8*a* lifts up the stacked sheets 3 during feeding. The lift plate 8*b* is installed underneath the pressing plate 8*a* to lift up the pressing plate 8*a* from a lower side. The lift plate 8*b* is supported rotatably on the sheet feeding tray 8 at a rear end thereof and is made to lift up the pressing plate 8*a* by a rotational driving force given thereto. The configuration of the lift plate 8*b* is described in, for example, JP-A-2006-176321 (US 2006/180986A1), the disclosure of which is incorporated herein by reference in its entirety A feed roller 10 is disposed at a front upper position of the sheet feeding tray 8, and brought into abutment with an uppermost one of the stacked sheets 3 in the sheet feeding tray 8, and a separation roller 11 is disposed in front of the feed roller 10. This separation roller 11 confronts a elastic separation pad 12. This separation pad 12 is urged upwards by a spring (not shown) to press a sheet or sheets 3 toward the separation roller 11.

Accordingly, if two or more sheets 3 are fed out by the feed roller 10, the sheets 3 are held between and separated by the separation roller 11 and the separation pad 12 one by one. A paper dust capture roller 13 and a confronting roller 14 are disposed in front of the separation roller 11 to confront each other. The sheet 3 passes through a nip between the paper dust capture roller 13 and the confronting roller 14, and then is turned to the rear along a transport path 19. Registration rollers 15 are disposed obliquely rearwards and upwards of the feed roller 10.

With the feeder part 4 thus configured, sheets 3 inside the sheet feeding tray 8 are lifted up by the lift plate 8*b* and the pressing plate 8*a*, and an uppermost sheet 3 is fed out to the separation roller 11 by the feed roller 10. Only the uppermost sheet 3 is fed out by friction between the separation roller 11 and the separation pad 12. This way, sheets 3 are transported to the image forming part 5 one by one.

1.2 Configuration of Image Forming Part

The image forming part 5 is provided in an interior of the casing 2 above the feeder part 4, and includes a scanner unit 20, a process cartridge 30 and a fixing unit 40 as an example of a fixing unit. The image forming part 5 is configured to form (hereinafter, also referred to as "print") an image on a sheet 3 by a so-called electrophotographic method.

1.2.1 Configuration of Scanner Unit

The scanner unit 20 is provided at an upper portion within the casing 2 and includes a laser emitting portion (not shown), a polygon mirror 21 which is driven to rotate, lenses 22, 23 and reflecting mirrors 24, 25. A laser beam emitted from the laser beam emitting portion based on image data passes through or is reflected by the polygon mirror 21, the lens 22, the reflecting mirror 24, the lens 23 and the reflecting mirror 25 sequentially in that order as indicated by a chain line, so as to be impinged onto a surface of a photosensitive drum 32 of the process cartridge 30 while scanning at high speed.

1.2.2 Configuration of Process Cartridge

The process cartridge 30 is provided below the scanner unit 20. The process cartridge 30 is detachably attached to the casing 2. This process cartridge 30 includes a photosensitive member cartridge 30A supporting the photosensitive drum 32 and a developer cartridge 30B detachably attached to the photosensitive member cartridge 30A. The developer cartridge 30B accommodates toner T as developer therein.

The photosensitive member cartridge 30A includes a case 31 forming an outer frame, and, within the case 31, the photosensitive drum 32, a scorotron-type charger 23 and a transfer roller 34. The developer cartridge 30B is detachably attached to the photosensitive member cartridge 30A and includes a developer case 35 accommodating therein developer, and, within the case 35, a developing roller 36, a supply roller 38 and an agitator 39 that are rotatable. Toner T within the developer case 35 is supplied to the developing roller 36 by the supply roller 38 rotating in a counterclockwise direction in FIG. 1. The toner T is charged positively between the supply roller 38 and the developing roller 36. The toner T supplied onto the developing roller 36 enters between a layer thickness regulating blade 37 and the developing roller 36 as the developing roller 36 rotates in the counterclockwise direction in FIG. 1, so that the toner T is carried on the developing roller 36 in the form of a thin layer of a constant thickness.

The photosensitive drum 32 is supported to the photosensitive case 31 which is coupled to the developer cartridge 30B. The photosensitive drum 32 is rotatable in a direction indicated by an arrow (in a clockwise direction). The photosensitive drum 32 is grounded and a surface portion thereof is formed by a positively chargeable photosensitive layer.

The scorotron-type charger 33 is disposed above the photosensitive drum 32. The charger 33 confronts the photosensitive drum 32 with a predetermined distance so as not to contact the photosensitive drum 32. This scorotron-type charger 33 is a positively electrifying charger which generates a corona discharge from a charging wire and is configured to charge uniformly the surface of the photosensitive drum 32 to a positive polarity.

The transfer roller 34 is disposed underneath the photosensitive drum 32 to confront and contact the photosensitive drum 32. The transfer roller 34 is supported by the photosensitive member case 31 to rotate in a direction indicated by an arrow (in a counterclockwise direction). The transfer roller 34 includes a metallic roller shaft and a conductive rubber material covering the roller shaft. A transfer bias is applied to the transfer roller 34 by a constant current control when transferring an image.

As the photosensitive drum 32 is rotated, the surface of the photosensitive drum 32 is positively charged uniformly by the charger 33. The positively charged surface of the photosensitive drum 32 is scanned and exposed by a laser beam emitted from the scanner unit 20. When the positively charged surface of the photosensitive drum 32 is exposed by the laser beam, potential of the exposed portion is lowered, so that an electrostatic latent image based on image data is formed on the surface of the photosensitive drum 32.

Following this, as the developing roller 36 is rotated, the positively charged toner T carried on the developing roller 36 is contacted with and thus supplied to the electrostatic latent image, i.e. the exposed portion, formed on the surface of the photosensitive drum 32. Consequently, the electrostatic latent image on the photosensitive drum 32 is visualized and a toner image resulting from reversal development is carried on the surface of the photosensitive drum 32. Thereafter, the toner image carried on the surface of the photosensitive drum 32 is transferred onto a sheet 3 by transfer bias applied to the transfer roller 34 when the sheet 3 passes through a nip between the photosensitive drum 32 and the transfer roller 34.

1.2.3 Configuration of Fixing Part

The fixing unit 40 is provided downstream of the process cartridge 30 and includes a heating roller 41 and a pressing roller 42. The heating roller 41 includes a heat source such as a halogen lamp and is driven to rotate. The pressing roller 42 is disposed underneath the heating roller 41 to confront and press the heating roller 41. The pressing roller 42 is also driven to rotate. With this fixing unit 40, when the heating roller 41 and the pressing roller 42 transport the sheet 3 while holding the sheet 3 therebetween, the toner T transferred on the sheet 3 is thermally fixed onto the sheet 3. The sheet 3 having the toner image thermally fixed thereto is transported further by transport rollers 43, which are disposed obliquely rearwards and upwards of the fixing unit 40, to a sheet discharging path 44. The sheet 3 in the sheet discharging path 44 is discharged onto a sheet discharging tray 46 by a discharge roller 45.

The fixing unit 40 includes a fixing unit cover 47 which is disposed at an inner side of the rear cover 2*a* and which covers the heating roller 41 and the pressing roller 42. One of the transport rollers 43, i.e. a rear transport roller 43, is supported rotatably on the fixing unit cover 47. This fixing unit cover 47 also functions as a guide which guides the sheet 3, passing through a nip between the heating roller 41 and the pressing roller 42, to the transport rollers 43.

Figure 2:
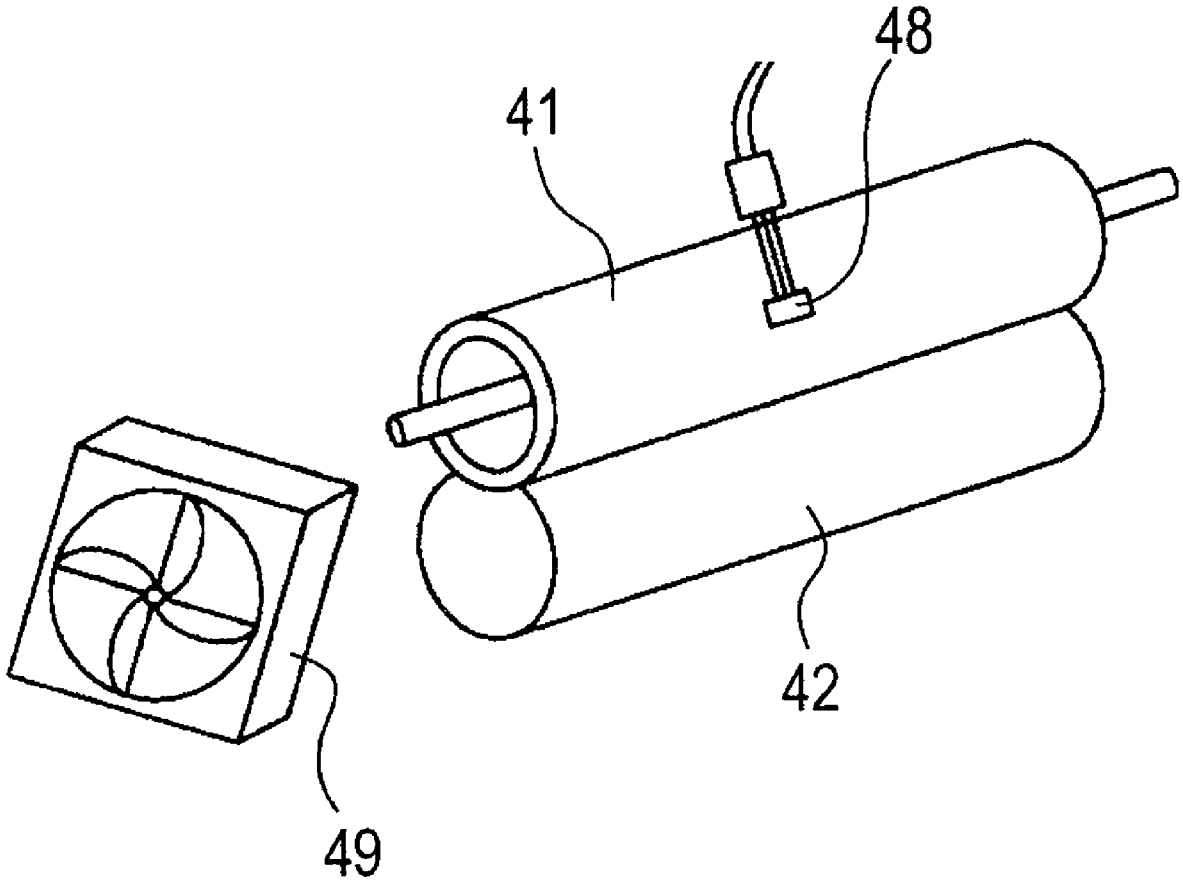
FIG. 2 is a perspective view showing exemplarily the configuration of the vicinity of a fixing unit of the laser printer.

As shown in FIG. 2, a thermistor 48 for detecting a surface temperature of the heating roller 41 is brought into contact with a surface of the heating roller 41, and a cooling fan 49 for cooling the heating roller 41 is provided on a side surface of the casing 2.

Returning to FIG. 1, the laser printer 1 includes sensors for detecting the existence of a sheet 3 in the transport path 3. Namely, a pre-registration sensor 71 is provided before the registration rollers 15, a post-registration sensor 72 after the registration rollers 15, a post-fixing sensor 73 between the heating roller 41 and the fixing unit cover 47 and a discharge sensor 74 between the transport roller 43 and the discharge roller 45.

2. Configurations of Fixing Unit Drive System and Fixing Unit Cover Lock Mechanism Next, configurations of a gear mechanism 80 and a lock mechanism 90 will be described. The gear mechanism 80 is configured to drive the heating roller 41 of the fixing unit 40, and the lock mechanism 90 is configured to restrict the opening and closing of the fixing unit cover 47. Note that the invention can be applied not only to a driving force transmission unit for driving the heating roller and but also to a driving force transmission unit for driving a component of a fixing unit, such as a pressing roller, a fixing drum and a fixing belt.

Figure 3A:
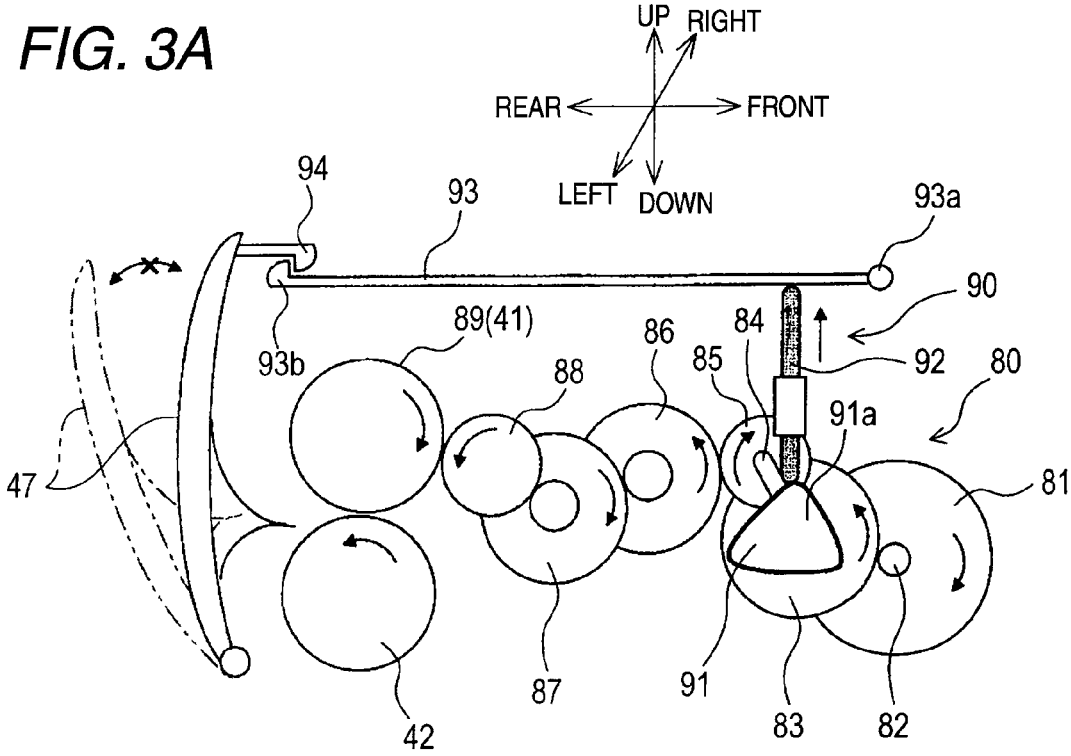
FIGS. 3(A) and 3(B) are explanatory diagrams showing exemplarily the configurations of a gear mechanism and a lock mechanism of the fixing unit.
Figure 3B:
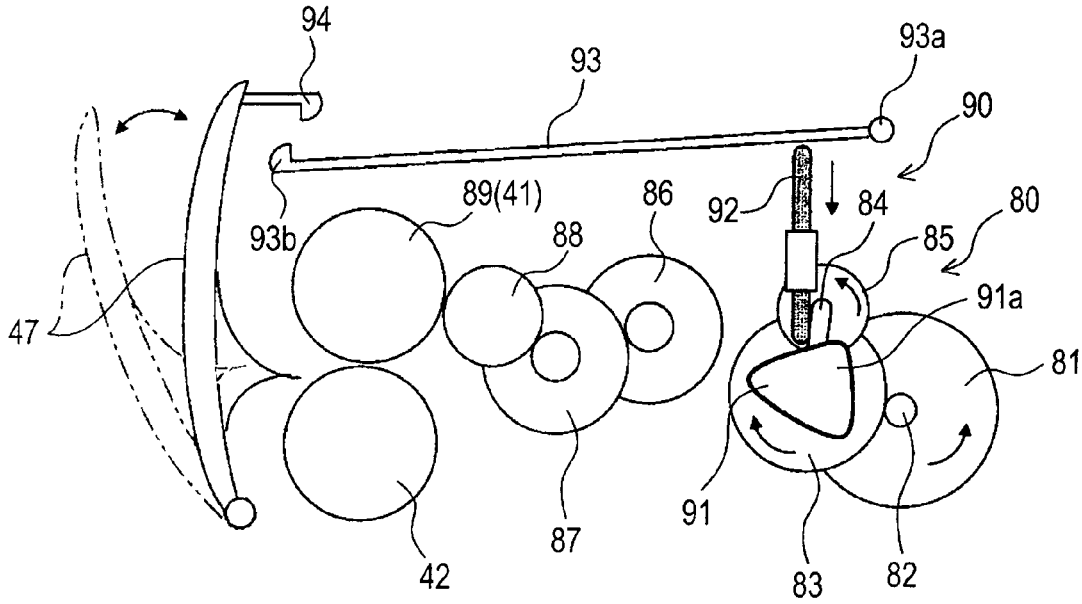

As shown in FIGS. 3(A) and 3(B), the gear mechanism 80 includes a pinion gear 82 fixed to a rotating shaft of a motor 81 and gears 83, 85, 86, 87, 88, 89 for transmitting the rotation of the pinion gear 82 to the heating roller 41. The gear 83 is constructed as a two-stage speed reduction gear having a large diameter gear and a small diameter gear. The pinion gear 82 meshes with a two-stage speed reduction gear 83 (the large diameter gear), and one end of a lever 84 is swingably disposed on a rotating shaft of the speed reduction gear 83. A planetary gear 85 meshes with the small diameter gear, not shown, of the speed reduction gear 83 and is supported rotatably at the other end of the lever 84. This planetary gear 85 is displaced according to a rotating direction of the speed reduction gear 83.

As shown in FIG. 3(A), when the motor 81 rotates in a direction in which a sheet 3 is transported (a clockwise direction in FIG. 3(A), the rotation of the motor 81 in that direction being hereinafter referred to as a forward rotation) and the pinion gear 82 also rotates in a direction indicated by an arrow in FIG. 3(A) (a clockwise direction), the speed reduction gear 83 rotates in a direction indicated by an arrow in FIG. 3(A) (a counterclockwise direction). Accordingly, the planetary gear 85 swings in the same direction to mesh with a large diameter gear of the speed reduction gear 86. By this action, the rotation of the planetary gear 85 is transmitted to the gear 88 via the speed reduction gear 86 and the speed reduction gear 87 as indicated by arrows in FIG. 3(A). The gear 88 meshes with the gear 89 which rotates together with the heating roller 41, and therefore when the motor 81 rotates in the clockwise direction, the rotation is transmitted to the heating roller 41 to rotate in a transport direction of the sheet 3 (a clockwise direction) indicated by an arrow in FIG. 3(A). By the rotation of the heating roller 41, the pressing roller 42 follows the rotation of the heating roller 41, and thus rotates in a direction indicated by an arrow in FIG. 3(A) (a counterclockwise direction).

During printing on a sheet 3, the motor 81 is rotated forwardly so that the heating roller 41 and the pressing roller 42 thermally fix an image on the sheet 3 while transporting the sheet 3. Note that in FIG. 3(A), the radius of the heating roller 41 and the radius of the gear 89 are identical as a matter of conveniences, but needless to say, the heating roller 41 and the gear 89 may have different radii.

As shown in FIG. 3(B), when the motor 81 rotates in a counterclockwise direction (hereinafter, the rotation of the motor 81 in that direction being referred to as a reverse rotation) and the pinion gear 82 also rotates in a direction indicated by an arrow in FIG. 3(B) (a counterclockwise direction), the speed reduction gear 83 rotates in a direction indicated by an arrow in FIG. 3(B) (a clockwise direction). Accordingly, the planetary gear 85 also swings in the same direction, whereby the meshing engagement of the planetary gear 85 with the large diameter gear of the speed reduction gear 86 is canceled. By this action, the rotation of the motor 81 is not transmitted to the gears of the gear mechanism 80, i.e. the speed reduction gear 86 and the subsequent gears downstream in the driving force transmission direction. Consequently, the heating roller 41 and the pressing roller 42 are rotatable freely.

The lock mechanism 90 includes a lock cam 91, a lock pin 92, a lock lever 93 and a hook 94. The lock cam 91 swings together with the lever 84. The lock pin 92 is brought into abutment with an outer circumference of the lock cam 91 at a lower end thereof for vertical motions. The lock lever 93 swings about one end 93*a* thereof. The hook 94 is formed integrally on the fixing unit cover 47. In addition, the respective members shown in FIGS. 3(A) and 3(B) are located closer to the near side of FIG. 1 or the left-hand side of the laser printer 1 than the section shown in FIG. 1.

The lock cam 91 has a substantially triangular outer circumference whose apexes are chamfered and thus rounded, and the lower end of the lock pin 92 comes into abutment with the outer circumference of the lock cam 91 by gravity. The upper end of the lock pin 92 is brought into abutment with a lower surface of the lock lever 93 As shown in FIG. 3(A), when the motor 81 rotates forwardly so that the planetary gear 85 meshes with the speed reduction gear 86, the lock pin 92 is pushed up by an apex 91*a* of the lock cam 91 to thereby push up the lock lever 93. The other end 93*b* of the lock lever 93 has a hook-like shape, and when the lock lever 93 is pushed up as shown in FIG. 3(A), the other end of the lock lever 93 is brought into engagement with the hook 94 to thereby prohibit the opening of the fixing unit cover 47. Namely, the opening of the fixing unit cover 47 is prohibited during printing.

As shown in FIG. 3(B), when the motor 81 rotates reversely to displace the planetary gear 85 in a direction canceling the meshing engagement between the planetary gear 85 and the speed reduction gear 86, the lower end of the lock pin 92 shifts from the apex 91*a* and thus is lowered. Accordingly, the lock lever 93 swings downwards to cancel the engagement between the other end 93*b* and the hook 94, and therefore the opening of the fixing unit cover 47 is permitted. Further, the "displacement part" according to the present invention is not limited to the planetary gear described above, and hence, a device like a clutch may be used to provide the same configuration.

3. Configuration of Control System of Laser Printer

Figure 4:
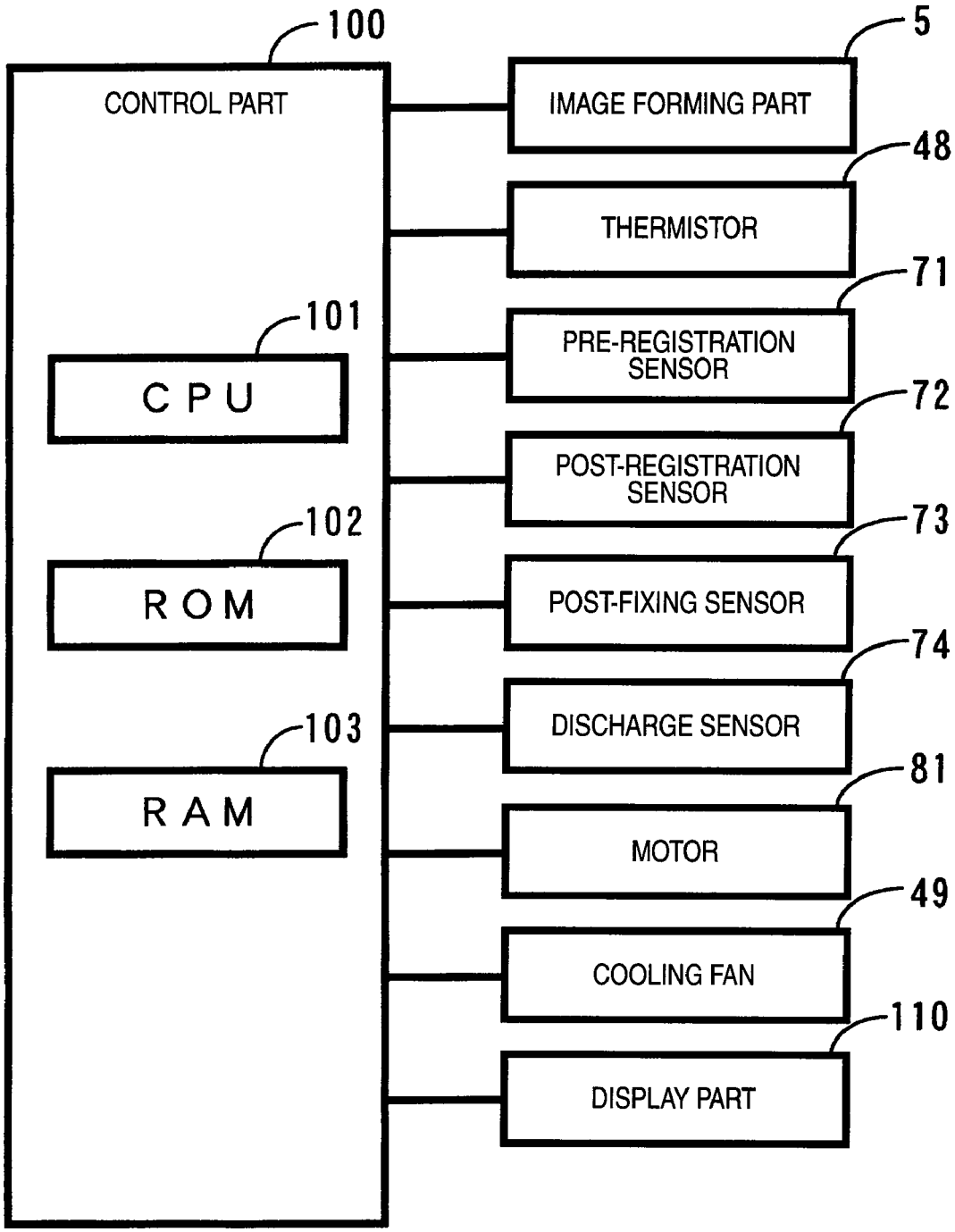
FIG. 4 is a block diagram showing the configuration of a control system of the laser printer.

Next, FIG. 4 is a block diagram showing the configuration of a control system of the laser printer 1. As shown in FIG. 4, the aforesaid image forming part 5, thermistor 48, pre-registration sensor 71, post-registration sensor 72, post-fixing sensor 73, discharge sensor 74, motor 81 and cooling fan 49, and a display part 110 are connected to a control part 100. In addition, the display part 110 includes a display provided on the surface of the casing 2. The control part 100 includes a microcomputer having a CPU 101, a ROM 102 and a RAM 103 and controls the motor 81, the cooling fan 49 and the display part 110 in a way which will be described below based on programs stored in the ROM 102.

4. Control in the Control System

Figure 5:
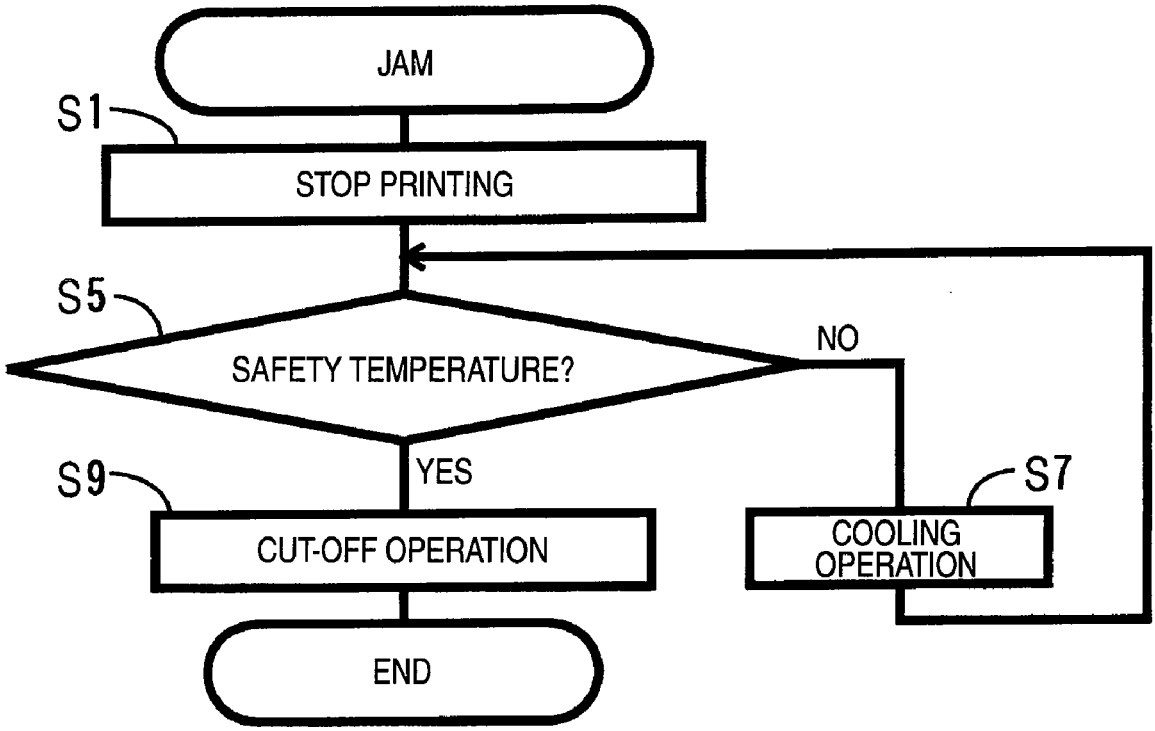
FIG. 5 is a flowchart showing an operation that is executed by the control system when a jam takes place.

Next, controls executed by the control part 100 will be described. FIG. 5 is a flowchart showing an operation that is executed as an interruption when a jam is detected. The jam is detected when detection signals by the pre-registration sensor 71, the post-registration sensor 72, the post-fixing sensor 73 and the discharge sensor 74 are not generated sequentially at predetermined timings during the transport of the sheet 3. When a jam is detected, the CPU 101 executes the following operation based on a program stored in the ROM 102.

As shown in FIG. 5, in a step S1, the forward rotation of the motor 81 is interrupted and the printing operation is stopped. At this point, the planetary gear 85 remains meshed with the speed reduction gear 86, and the opening of the fixing unit cover 47 is prohibited. Therefore, even though the user opens the rear cover 2*a*, the user cannot open the fixing unit cover 47, and hence, the user is protected from touching the heating roller 41 mistakenly.

Figure 6:
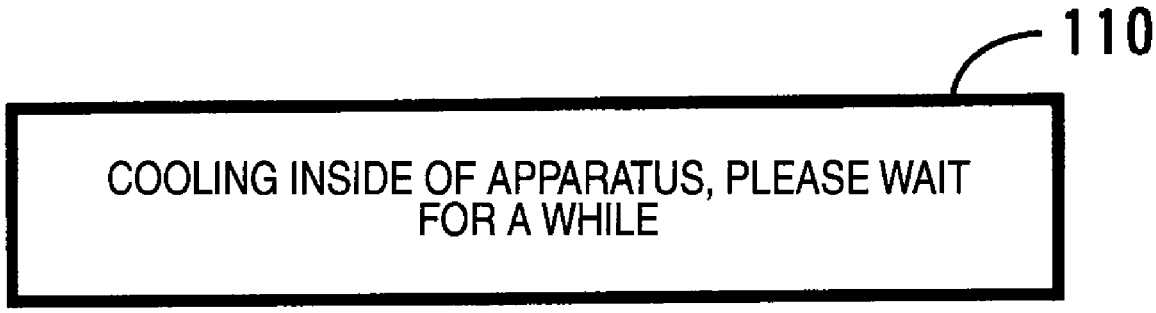
FIG. 6 is an explanatory diagram illustrating a display that is displayed on a display unit in the operation.

In a subsequent step S5, it is determined based on a detection signal from the thermistor 48 whether or not the temperature of the heating roller 41 is lowered to a temperature at which the hand is kept safe even though the user touches the heating roller 41. If the temperature of the heating roller 41 is not lowered to the safety temperature (S5: N), in a step S7, the cooling fan 49 is activated to execute a cooling operation for cooling the heating roller 41, and the operation returns to S5. When the cooling fan 49 is driven in the step S7, information as shown in FIG. 6 is displayed on the display part 110 to inform the user that the apparatus is under cooling due to the high temperature of the fixing unit 40.

When the temperature of the heating roller 41 is lowered to the safety temperature by repeating the operations in S5 and S7 (S5: Y), the operation proceeds to a step S9 where the following force transmission cut-off operation is executed. Namely, by rotating the motor 81 a predetermined amount reversely, the meshing engagement between the planetary gear 85 and the speed reduction gear 86 is canceled, and the engagement between the other end 93*b* of the lock lever 93 and the hook 94 is also canceled. Accordingly, since the heating roller 41 and the pressing roller 42 are rotatable freely and the opening of the fixing unit cover 47 is permitted, a jammed sheet 3 can easily be taken out. When the force transmission cut-off operation described above is executed in S9, the operation ends.

5. Advantage of the Embodiment and Modified Example Thereto

As described above, the configuration for putting the heating roller 41 and the pressing roller 42 into a freely rotatable state (the planetary gear 85) and the configuration for permitting the opening of the fixing unit cover 47 (the lock lever 93) are linked with each other via the lock cam 91 and the lock pin 92. Moreover, in this embodiment, these configurations are operated according to the rotating direction of the motor 81. Therefore, the image forming apparatus can be simplified so as to reduce the production costs thereof properly. Moreover, since the force transmission cut-off operation (S9) is executed after the temperature of the heating roller 41 is lowered to the safety temperature (S5: Y), the safety can also be ensured. Furthermore, the heating roller 41 can be cooled quickly by driving the cooling fan 49 and since the display part 110 displays a message, such as "the apparatus is under cooling" during operation of the cooling fan 49, the user can know the reason why the fixing apparatus cover 47 can not be opened.

Figure 7:
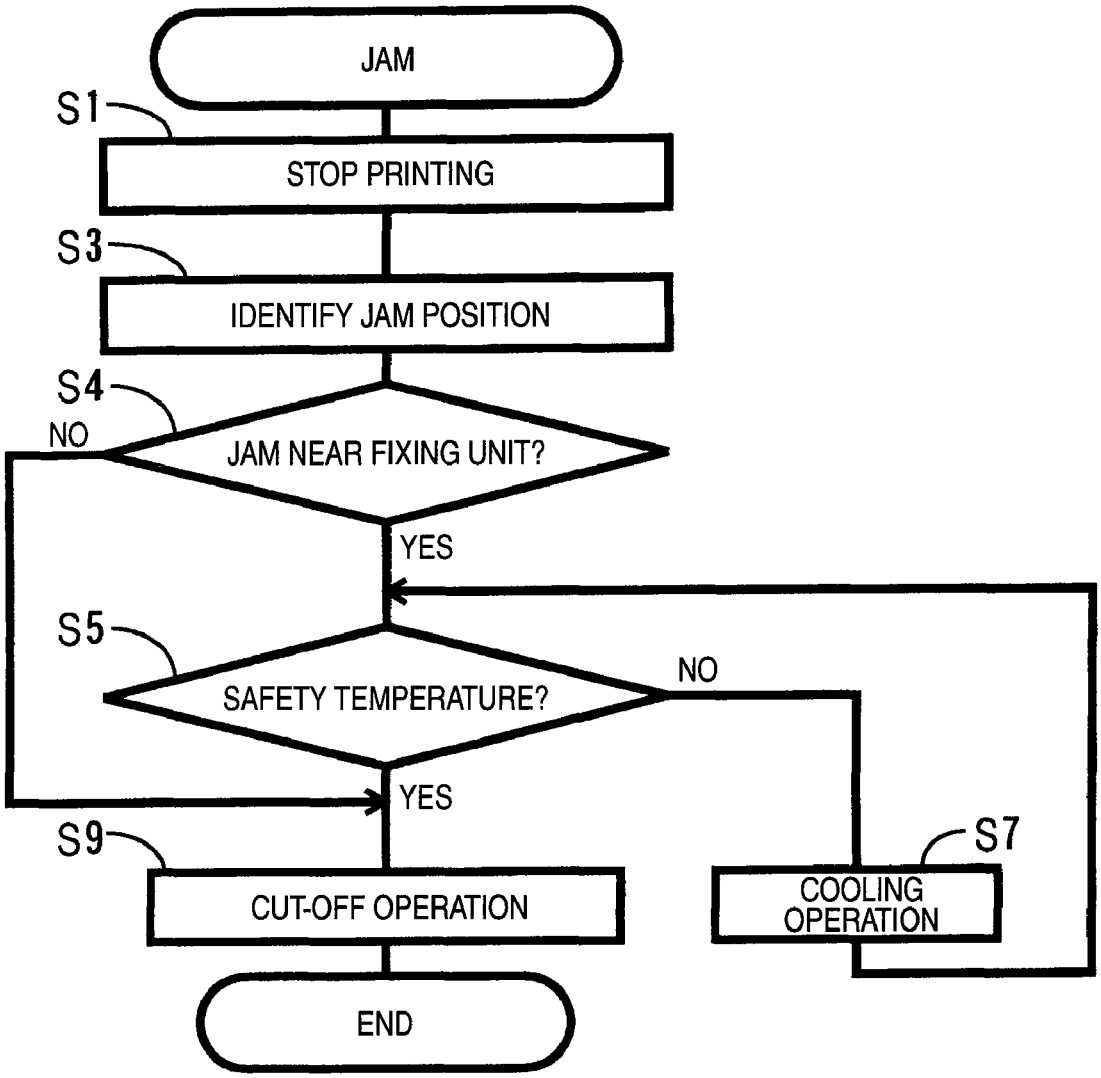
FIG. 7 is a flowchart showing a modified example to the operation.

Note that the invention is not limited to the embodiment that has been described heretofore but can be modified variously without departing from the spirit and scope of the invention. For example, in the operation controlled by the control part 100, S3 and S4 may be inserted between S1 and S5 as shown in FIG. 7. Since an operation of a flowchart shown in FIG. 7 is the same as the operation shown in FIG. 5 except that S3 and S4 are inserted, only different features will be described in the following description.

As shown in FIG. 7, when the printing operation is stopped in S1, a subsequent step S3 identifies a jammed position (a position where a sheet 3 is jammed) based on conditions detected by the pre-registration sensor 71, the post-registration sensor 72, the post-fixing sensor 73 and the discharge sensor 74. Then, in S4, it is determined based on the result of S3 whether or not a jam occurs in the vicinity of the fixing unit 40. For example, if the post-fixing sensor 73 detects the sheet 3 but the discharge sensor 74 does not detect the sheet 3, it can be determined that a jam occurs in the vicinity of the fixing unit 40. If no jam occurs in the vicinity of the fixing unit 40 (S4: N), there exist extremely least possibility that the user inserts his or her hand to the periphery of the heating roller 41 to eliminating the jam.

If it is determined in S4 that a jam occurs in the vicinity of the fixing unit 40 (S4: Y), the operation proceeds to the aforementioned step S5, where the same operation as that described before is executed. If no jam occurs in the vicinity of the fixing unit 40 (S4: N), the operation proceeds directly to S9 irrespective of the temperature of the heating roller 41.

According to the operation described just above, when no jam occurs in the vicinity of the fixing unit 40 and hence there is extremely least possibility that the user inserts his or her hand into the vicinity of the heating roller 41 to eliminating a jam, the heating roller 41 and the pressing roller 42 are put into freely rotatable state, and the opening of the fixing unit cover 47 is also permitted. Therefore, for example, when the sheet 3 is transported so downstream of the fixing unit 40 as to be detected by the discharge sensor 74 with only one end of the sheet 3 held between the heating roller 41 and the pressing roller 42, that is, when an amount of the sheet 3, transported downstream of the fixing unit 40 is not less than a given amount, the sheet 3 can be taken out without waiting until the temperature of the heating roller 41 is lowered to the safety temperature. Accordingly, the operability of the image forming apparatus is increased further.

In the event that the projecting amount of the apex 91*a* of the lock cam 91 is designed to be large, the following two-stage canceling operation is possible. Namely, as shown in FIGS. 8(A) and 8(B), in a case that the apex 91*a* is formed to project largely, the lock pin 92 can be held in the raised position when the lock pin 92 confronts not only the apex 91*a* but also a portion of the lock cam 91 within a certain angular range around the apex 91*a*. Accordingly, when the motor 81 is rotated reversely slightly from a state shown in FIG. 8(A) in which the printing operation is stopped (S1) to a state shown in FIG. 8(B), the planetary gear 85 swings to cancel the meshing engagement between the planetary gear 85 and the speed reduction gear 86 but the lock pin 92 is still held in the raised position to prohibit the opening of the fixing apparatus cover 47. When the motor 81 is further rotated reversely from the state shown in FIG. 8(B) to a state shown in FIG. 8(C), the lock pin 91 is also lowered with the meshing engagement between the planetary gear 85 and the speed reduction gear 86 kept canceled, thereby permitting the opening of the fixing unit cover 47.

Figure 8:
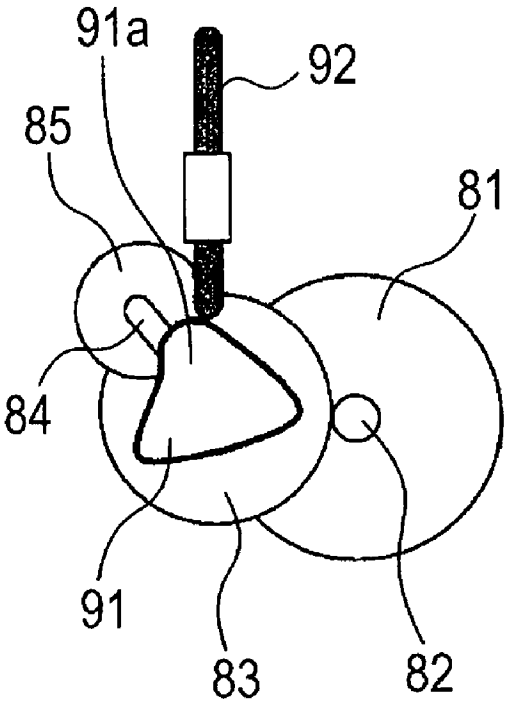
FIGS. 8(A), 8(B) and 8(C) are explanatory diagrams showing a modified example to the lock mechanism.
Figure 8:
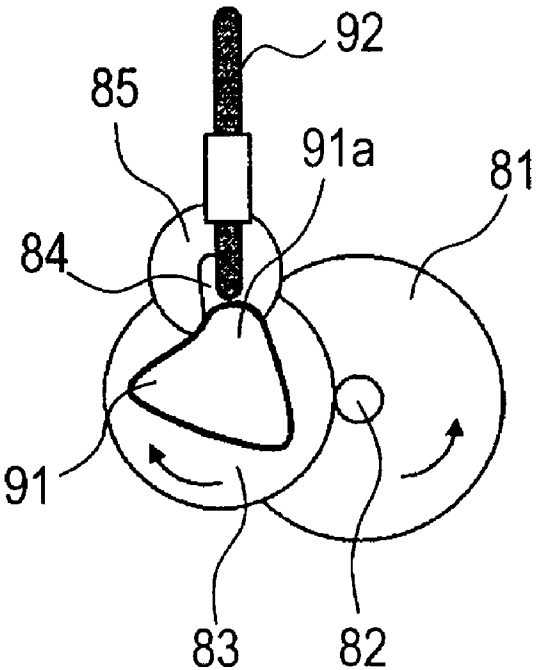
Figure 8:
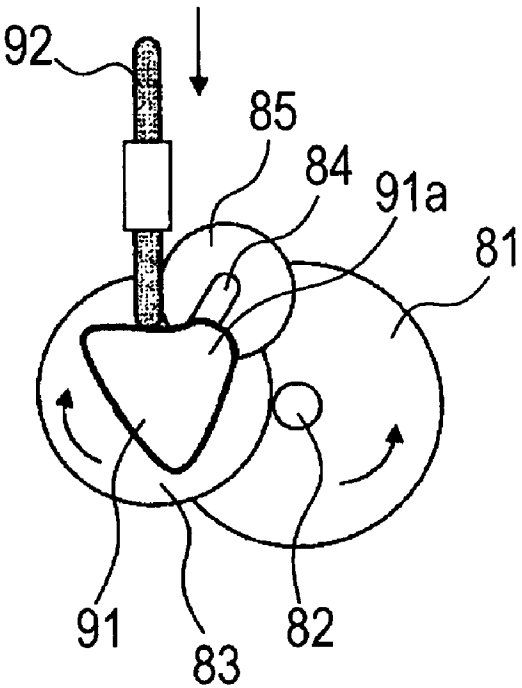
Figure 9:
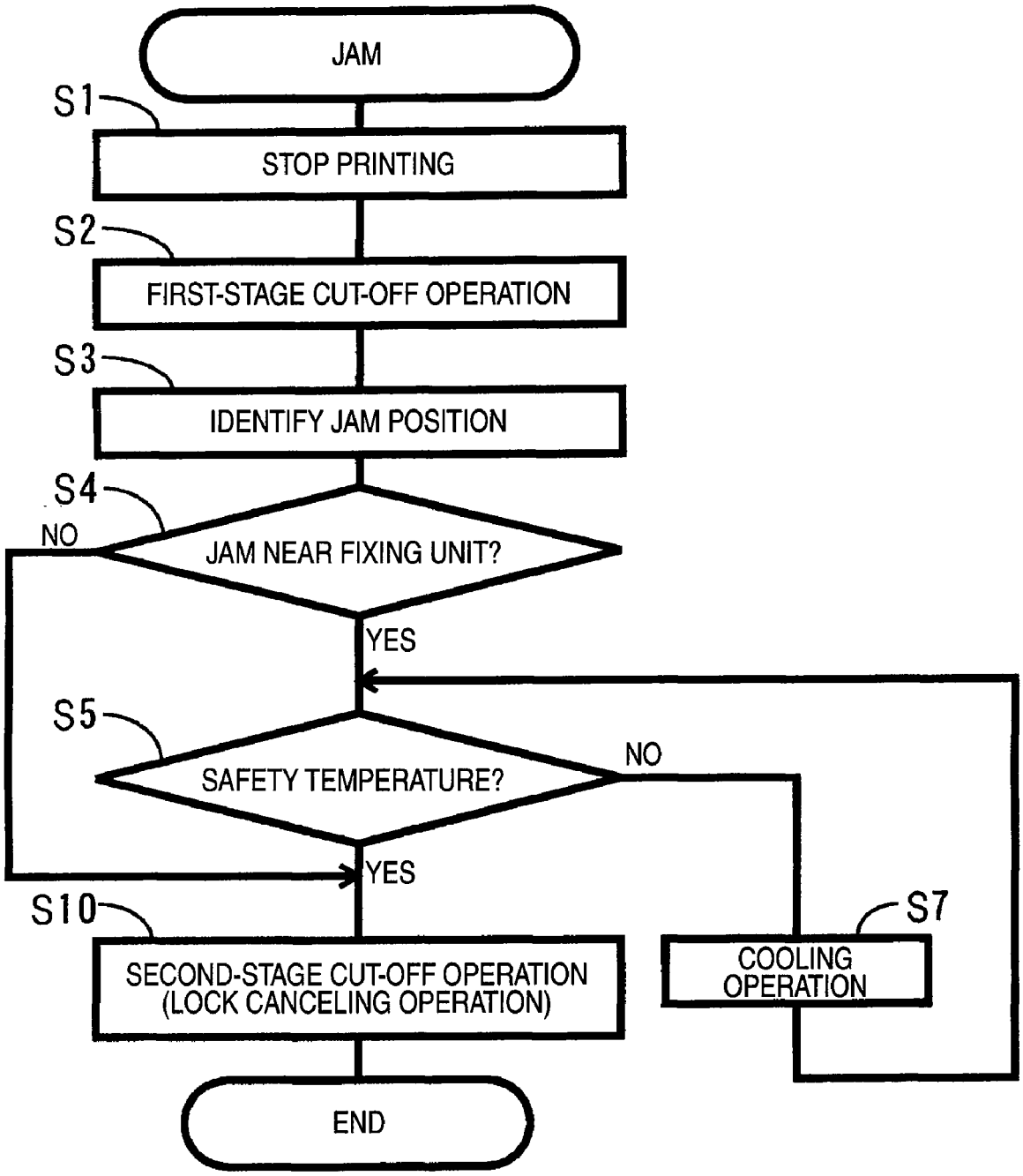
FIG. 9 is a flowchart showing a modified example to the operation which corresponds to the modified lock mechanism.

When the lock cam 91 is configured in this way described above, the following control is applicable. FIG. 9 is a flowchart illustrating a modified example to the operation described above which will take place when the lock cam 91 shown in FIG. 8 is adopted. Note that since this operation is the same as the operation in FIG. 7 except that S2 is inserted between S1 and S3 and that the S9 is replaced by S10, only different features will be described in the following description.

As shown in FIG. 9, when the printing operation is stopped in S1, the subsequent step S2 executes a first-stage force transmission cut-off operation. Namely, the first-stage force transmission cut-off operation (shown in FIG. 8(B)) permits the free rotation of the heating roller 41 and the pressing roller 42 without permitting the opening of the fixing unit cover 47. The operation proceeds to S3 described above. Then, in conjunction with the execution of the first-stage force transmission cut-off operation in S2 in the way described above, in S10 which replaces S9, the motor 81 is rotated reversely further from the state shown in FIG. 8(B) in which the first-stage force transmission cut-off operation is executed, to execute a second-stage force transmission cut-off operation in which the opening of the fixing unit cover 47 is permitted as shown in FIG. 8(C).

In the event that the operation described just above is adopted, the free rotation of the heating roller 41 and the pressing roller 42 is enabled in S2 immediately after the printing operation is stopped in S1. Accordingly, the sheet 3 can be taken out without opening the fixing unit cover 47 by pinching with the fingers the sheet 3 transported downstream of the transport rollers 43. In this case, the sheet 3 can be taken out without waiting until the temperature of the heating roller 41 is lowered to the safety temperature, and therefore the operability of the image forming apparatus can be increased further.

Further, the "cover" in the invention is not limited to the fixing unit cover 47, and hence, for example, the same configuration may be applied to the rear cover 2*a*. Furthermore, the "fixing unit" in the invention is not limited to the unit including the heating roller 41 and the pressing roller 42, and hence, the configuration can be applied to various types of fixing units including one in which one of the rollers has a platen shape.

As discussed above, the present invention can provide at least the following illustrative, non-limiting embodiments:

(1) An image forming apparatus including an image forming unit for forming an image on a recording medium, a fixing unit having a heating part and adapted to thermally fix the image on the recording medium while transporting the recording medium by at least part thereof being driven to rotate, a rotary drive unit for driving the fixing unit to rotate in a transport direction of the recording medium, a driving force transmission unit comprising a displacement part which is displaced according to a rotating direction of the rotary drive unit to a transmitting position where the rotation of the rotary drive unit is transmitted to the fixing unit and a non-transmitting position where the rotation of the rotary drive unit is not transmitted to the fixing unit, a cover which covers the heating part, a lock unit for switching the cover between a prohibition state in which opening of the cover is prohibited and a permission state in which the opening of the cover is permitted, and a link unit for switching the lock unit to the prohibition state when the displacement part is displaced to the transmitting position and switching the lock unit to the permission state when the displacement part is displaced to the non-transmitting position, in linking with the displacement of the displacement part of the driving force transmission unit.

According to the image forming apparatus of (1), the image is formed on the recording medium by the image forming unit, and then the fixing unit having the heating part thermally fixes the image onto the recording medium while transporting the recording medium by at least the part thereof being driven to rotate.

The driving force transmission unit includes the displacement part which is displaced according to the rotating direction of the rotary drive unit, and the displacement part is displaced to the transmitting position where the rotation of the rotary drive unit is transmitted to the fixing unit to rotate the fixing unit in the transport direction of the recording medium and the non-transmitting position where the rotation of the rotary drive unit is not transmitted to the fixing unit. In linking with the displacement of the displacement part, the link unit switches the lock unit between the prohibition state and the permission state as below. Namely, when the displacement part is displaced to the transmitting position, the link unit switches the lock unit to the prohibition state, whereas when the displacement part is displaced to the non-transmitting position, the link unit switches the lock unit to the permission state.

In this way, the link unit links the configuration (the displacement part of the driving force transmission unit) in which the rotation of the rotary drive unit is not transmitted to the fixing unit so as to allow the fixing unit to rotate freely with the configuration (the lock unit) in which the locking of the cover for covering the heating part is canceled. Moreover, these configurations are put into operation according to the rotating direction of the rotary drive unit. Consequently, the configuration of the image forming apparatus can be simplified so as to decrease the production costs thereof.

(2) The image forming apparatus of (1), wherein the fixing unit has at least one roller and transports the recording medium having the image formed thereon by the image forming unit, and the rotary drive unit drives the roller to rotate in the transport direction of the recording medium. According to the image forming apparatus of (2), since the roller of the fixing unit rotates freely when the displacement part is displaced to the non-transmitting position, the recording medium can easily be taken out even when a jam occurs at the fixing unit.

(3) The image forming apparatus of (1) or (2), further including a temperature detection unit for detecting a temperature of the heating part and a first non-transmission control unit for rotating the rotary drive unit in a direction in which the displacement part is displaced to the non-transmitting position when the detected temperature detected by the temperature detection unit is lowered to a predetermined temperature or lower after the rotation of the rotary drive unit is stopped.

According to the image forming apparatus of (3), since the first non-transmitting control unit enables the fixing unit to rotate freely and the locking of the cover is canceled after the temperature of the heating part that is detected by the temperature detection unit is lowered to the predetermined temperature (for example, a temperature at which the hand is kept safe even when the hand is inserted to the vicinity of the heating part) after the rotary drive unit is stopped, the safety is increased.

(4) The image forming apparatus of (3), further including a fan for cooling the heating part by blowing air thereto at least when the detected temperature detected by the temperature detection unit is higher than the predetermined temperature. According to the image forming apparatus of (4), the heating part can be cooled down quickly to the predetermined temperature or lower by blowing air by the fan.

(5) The image forming apparatus of (3) or (4), further including a display unit for, when the detected temperature detected by the temperature detection unit is higher than the predetermined temperature, displaying a message indicating a condition in which the detected temperature detected by the temperature detection unit is higher than the predetermined temperature or indicating information relating to the condition. According to the image forming apparatus of (5), the user can be informed of a condition in which the temperature of the heating part is higher than the predetermined temperature or information relating thereto, and thus the user can know the reason why the cover cannot be opened.

(6) The image forming apparatus of any one of (1) to (5), further including a transport amount determination unit for determining whether or not an amount of the recording medium, transported downstream of the heating part of the fixing unit is equal to or larger than a predetermined amount when the rotation of the rotary drive unit is stopped, and a second non-transmission control unit for rotating the rotary drive unit in a direction in which the displacement part is displaced to the non-transmitting position when the transport amount determination unit determines that the amount is equal to or lager than the predetermined amount. According to the image forming apparatus of (6), when the transport amount determination unit determines that the amount of the recording medium, transported downstream of the heating part when the rotary drive unit is stopped is equal to or larger than a predetermined amount (for example, an amount which allows the user to take out the recording medium with safe irrespective of the temperature of the heating part), the second non-transmission control unit enables the fixing unit to rotate freely. Accordingly, the image forming apparatus can provide an opportunity that the user can take out the recording medium without waiting for a reduction in the temperature of the heating part, thereby making it possible to increase further the operability of the image forming apparatus.

(7) The image forming apparatus of any one of (1) to (6), wherein the displacement part of the driving force transmission part includes a planetary gear having a rotating shaft, the position of which is displaced according to a rotating direction of the rotary drive unit and the planetary gear which selectively switches transmission/non-transmission of the rotation of the rotary drive unit according to a position of the rotating shaft. According to the image forming apparatus of (7), the configuration of the driving force transmission unit can be simplified further, thereby making it possible to reduce the production costs of the image forming apparatus more effectively.

(8) The image forming apparatus of (7), wherein the displacement part is displaced to at least two non-transmitting positions, a first non-transmitting position and a second non-transmitting position, according to a rotating amount of the rotary drive unit in a direction in which the displacement part is displaced to the non-transmitting position, so that in the first-non-transmitting position, which corresponds to a side where the rotating amount is small, the planetary gear is disposed in a position where the rotation is not transmitted, but the lock unit is not switched to the permission state via the link unit, while in the second non-transmitting position, which corresponds to a side where the rotating amount is large, the lock unit is switched to the permission state via the link unit with the planetary gear left disposed in the position where the rotation is not transmitted. According to the image forming apparatus of (8), in the first non-transmitting position, the recording medium can be taken out only when the recording medium is transported so sufficiently that the recording medium can be taken out without opening the cover, and in the second non-transmitting position, the recording medium lying in the vicinity of the heating part can be taken out by opening the cover. When the two-stage cancellation is adopted in the way described above, the image forming apparatus can provide an opportunity that the user can take out the recording medium without waiting for a reduction in the temperature of the heating part, thereby making it possible to increase further the operability of the image forming apparatus while ensuring the safety.

What is claimed is:

1. An image forming apparatus comprising:

an image forming unit configured to form an image on a recording medium;

a fixing unit having a heating part and configured to thermally fix the image on the recording medium while transporting the recording medium when at least part of the fixing unit is rotated;

a rotary drive unit;

a driving force transmission unit configured to selectively transmit rotation of the rotary drive unit to the at least part of the fixing unit, the driving force transmission unit comprising a displacement part which is displaceable to a transmitting position where the rotation of the rotary drive unit is transmitted to the fixing unit when the rotary drive unit is rotated in a first direction and to a non-transmitting position where the rotation of the rotary drive unit is not transmitted to the fixing unit when the rotary drive unit is rotated in a second direction opposite the first direction;

a cover configured to cover the heating part;

a lock unit configured to selectively lock the cover; and a link unit configured to link the lock unit with the displacement part so that the lock unit locks the cover when the displacement part is displaced to the transmitting position and unlocks the cover when the displacement part is displaced to the non-transmitting position.

2. An image forming apparatus as set forth in claim 1, wherein the fixing unit includes at least one roller configured to transport the recording medium, and wherein the rotary drive unit is configured to rotate the roller via the drive force transmission unit to transport the recording medium.

3. An image forming apparatus as set forth in claim 1, further comprising:

a temperature detection unit configured to detect a temperature of the heating part; and a controller configured to rotate the rotary drive unit in the second direction when the temperature detected by the temperature detection unit is not higher than a given temperature after the rotation of the rotary drive unit is stopped.

4. An image forming apparatus as set forth in claim 3, further comprising:

a fan configured to cool the heating part when the temperature detected by the temperature detection unit is higher than the given temperature after the rotation of the rotary drive unit is stopped.

5. An image forming apparatus as set forth in claim 3, further comprising:

a display unit configured to display a message indicating a condition in which the temperature detected by the temperature detection unit is higher than the given temperature or indicating information relating to the condition.

6. An image forming apparatus as set forth in claim 1, further comprising:

a controller configured to determining whether or not an amount of the recording medium, transported downstream of the heating part, is less than a given amount when the rotation of the rotary drive unit is stopped, and to rotate the rotary drive unit in the second direction when the amount of the sheet is not less than the given amount.

7. An image forming apparatus as set forth in claim 1, wherein the displacement part includes a planetary gear swingably displaceable between the transmitting position and the non-transmitting position, the planetary gear at the transmitting position couples the rotary drive unit to the fixing unit via the driving force transmission unit and the planetary gear at the non-transmitting position dis-couples the rotary drive unit from the fixing unit.

8. An image forming apparatus as set forth in claim 7, wherein the planetary gear can be selectively stopped at one of the non-transmitting position and an intermediate position between the transmitting position and the non-transmitting position depending on an amount of rotation of the rotary drive unit in the second direction, the planetary gear at the intermediate position dis-couples the rotary drive unit from the fixing unit, and the link unit is configured to hold the lock unit to lock the cover when the planetary gear is stopped at the intermediate position.

* * * * *